United States Patent [19]

Devaney et al.

[11] 4,121,739

[45] Oct. 24, 1978

[54] DISPENSER WITH UNITARY PLUNGER AND SEAL CONSTRUCTION

[75] Inventors: William David Devaney, Methuen; Robert Francis Call, Hamilton, both of Mass.

[73] Assignee: Illinois Tool Works Inc., Chicago, Ill.

[21] Appl. No.: 789,049

[22] Filed: Apr. 20, 1977

[51] Int. Cl.[2] ..... B67D 5/52

[52] U.S. Cl. ..... 222/137; 222/386; 92/243; 128/218 P

[58] Field of Search ..... 222/137, 386; 92/249, 92/253, 242, 243; 128/218 P

[56] References Cited

U.S. PATENT DOCUMENTS

| | | | |
|---|---|---|---|
| 3,766,918 | 10/1973 | Kessel | 128/218 P |
| 3,827,602 | 8/1974 | Nicholls | 222/137 |
| 3,828,980 | 8/1974 | Creighton et al. | 222/137 |

FOREIGN PATENT DOCUMENTS

| | | | |
|---|---|---|---|
| 1,242,737 | 8/1960 | France | 128/218 P |
| 536,511 | 2/1922 | France | 128/218 P |
| 2,291,702 | 6/1976 | France | 128/218 P |

*Primary Examiner*—Robert B. Reeves
*Assistant Examiner*—Charles A. Marmor
*Attorney, Agent, or Firm*—Thomas W. Buckman; Robert W. Beart

[57] ABSTRACT

A dispenser for precisely metering viscous fluids from a cartridge. The dispenser includes a cartridge body and a plunger having a piston head at its extremity. The plunger is unitarily configured from a plastic material, including seal rings in the piston head. Each piston head including two such seal rings axially spaced from one another and configured to include sharp peripheral edges permitting resilient wedging contact within the bore of the cartridge.

2 Claims, 5 Drawing Figures

DISPENSER WITH UNITARY PLUNGER AND SEAL CONSTRUCTION

BACKGROUND AND SUMMARY OF THE INVENTION

Dispensers for epoxy-type adhesives including two distinct compartments in a single cartridge body, such as that shown in U.S. Pat. No. 3,828,980, are currently available. Such dispensers permit the precise metering of two viscous adhesive components onto a discrete work surface. While such dispensers currently available do provide a convenient and reliable metering of such component adhesives, they have heretofore required a two-part plunger consisting of the plunger shaft, configured to have certain structural capabilities, and a seal cap, of a material dissimilar from the shaft and designed to have certain sealing capabilities. Since the use of such a dispenser is generally for consumers' home repair or industrial use, it must be of a rugged and reliable configuration. Thus, the structural characteristics of the plunger shaft could not heretofore be configured to provide the necessary sealing characteristics. The use of such two-part plungers has proven to be costly due to material costs and production time.

While certain modifications to the dispenser described above have been made to provide a unitary construction of a pair of parallel plunger shafts to be accommodated within a unitary cartridge including a pair of parallel compartments, such modifications still require the placement of discrete seal members at the extremity of each plunger shaft.

Accordingly, it is a primary object of this invention to provide a dispenser for metering fluids which minimizes the number of parts used in such a unit.

A more specific object of this invention is the provision of a plunger member in a dispenser which includes integrally formed seal means at the piston head, therefore eliminating separate seal elements.

Still a further object of the invention is to provide a plunger for use in a plurality of chambers simultaneously and more particularly a plunger for use with viscous materials which include an integral double lipped seal at the piston head.

In general, these objects are obtained by the dispenser of the present invention which consists of two parts, namely a cartridge having two or more cylindrical compartments and a piston or plunger unit which includes a corresponding number of piston shafts integrally joined at the top and including particularly configured seal rings unitarily configured at the opposite extremity of the shafts.

The seal region of each shaft includes a pair of axially spaced seal rings having sharp edges at their outer periphery. The outer peripheral region of each seal ring includes a frustoconical surface with the frustoconical surface of the ring nearest the extremity tapering backwardly from the extremity while the frustoconical surface of the rearward ring tapers forwardly toward the extremity. The forward ring is further configured to include a step-like surface resulting from an inner, shallow, frustoconical surface being connected to the outer surface by a short cylindrical surface. The particular elements making up the unitary configuration of the piston shafts and the advantages of these features will become apparent from the following description when read in conjunction with the accompanying drawings.

DETAILED DESCRIPTION OF THE INVENTION

Figure 1:
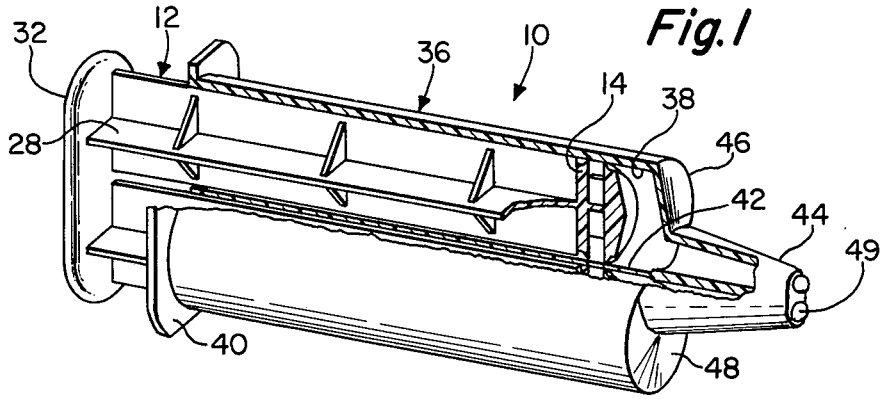
FIG. 1 is an isometric view, partially cut away, of a two-compartment dispenser using the features of this invention.

As shown in FIG. 1, the dispenser unit 10 consists of two, totally unitary portions. A unitary plunger unit 12 is telescopically associated with a unitary cartridge body 36. The plunger unit consists of, preferably a pair of parallel piston shafts 28 interconnected at their uppermost extremities by a flange-like plunger activating bridging portion 32. The opposite extremity of each shaft includes a piston head 14 to be described in detail later herein. The cartridge body 36 will include an integral radially extending flange 40 at the mouth a pair of parallel compartments in the form of cylindrical bores 38. These bores are interconnected with an adjoining wall region 42. Thus a pair of compartments are provided for receiving two dissimilar components of an epoxy-type adhesive system which are designed to interact with one another upon admixing. The extremitites opposite the mouth of the compartments lead into smaller channels forming a nozzle region 44.

Figure 5:
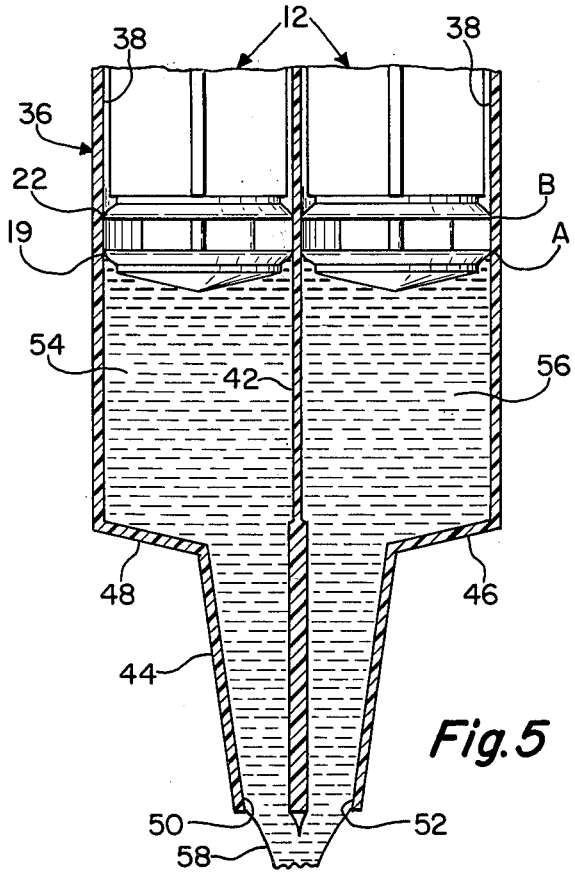
FIG. 5 is a fragmentary side view, partially in section, of the dispenser in operation.

The invention described herein, particularly the unitary configuration of the plunger unit 12 and piston head 14, has particular significance in the dispensing of two-part epoxy material, which are relatively viscous and thus are difficult to seal when applied in a pressure plunger-type of system. To use a dispenser such as the type described herein, and more particularly shown in FIG. 5, nozzle seals 49 will be cut away from the extremity of the nozzle region forming a pair of closely adjacent, small diameter orifices 50 and 52. The orifices 50 and 52 are interconnected to the bases 46 and 48 of the compartments through channels of decreasing transverse dimensions. Upon exertion of hand pressure on the activating flange 32, facilitated by the cartridge flange 40, the viscous epoxy resin material 54 and 56 are forced through the nozzle into a mixed or closely adjacent path 58. Thereafter, a simple brushing or swipe with a knife blade or the like will create the necessary admixing of the two elements permitting the epoxy to cure.

Figure 3:
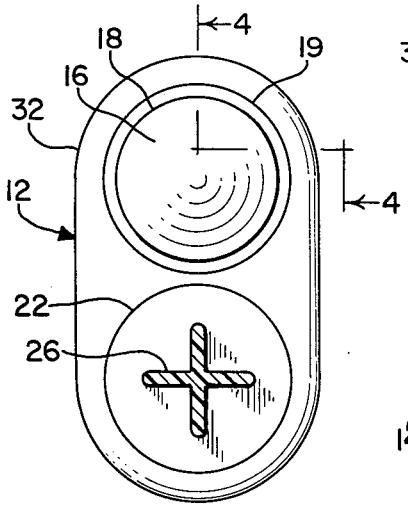
FIG. 3 is an end view of the plunger unit of FIG. 2 taken along lines 3—3 thereof showing one of the piston heads in cross section.
Figure 2:
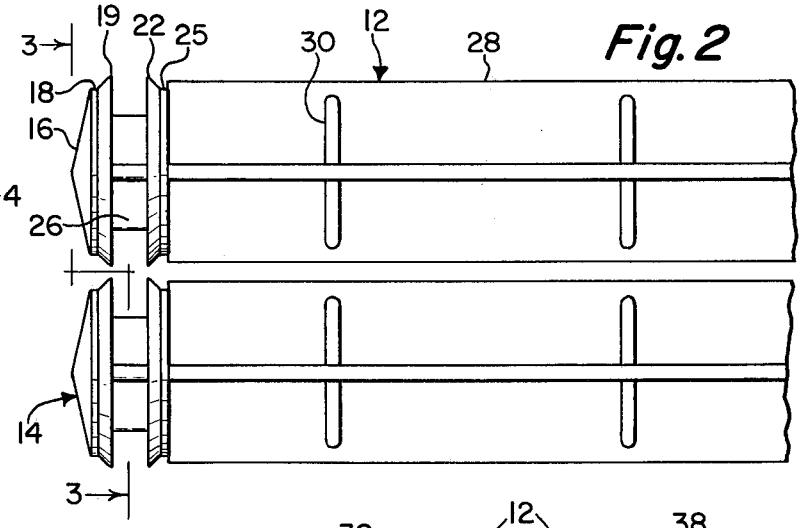
FIG. 2 is a partial side view of the plunger unit of the present invention showing the piston head regions thereof.
Figure 4:
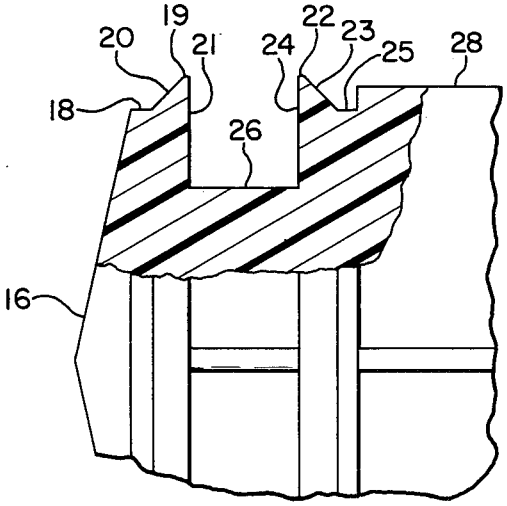
FIG. 4 is an enlarged partial side view, taken along lines 4—4 of FIG. 3.

A reference to FIGS. 2–4 will facilitate the description of the unitary piston head 14. Since each of the piston heads are identical, only one will be described in detail. Piston heads 14 include two, axially spaced, sealing ring configurations. Sealing ring 19, which is nearest the free extremity of the piston head, is spaced from piston ring 22 and interconnected thereto by a cruciform shaped shaft element 26. The front face 16 of the piston head is configured as a frustonical surface which is in part complementary to the end surface 46 and 48 at the base of the compartments in cartridge 36 and which form the entrance to the nozzle region 44.

A short, cylindrical surface 18 is formed on the piston head interconnecting the front surface 16 with the sealing ring 19. The seal ring 19 is also configured to have a frustoconical surface 20 tapering backwardly from the free extremity of the piston head. This frustoconical surface merges with a generally flat surface 21 extending perpendicularly to the axis of the associated piston shaft 28. A sharp edge is thus formed at the intersection of the surfaces 20 and 21.

Rear seal 22 is essentially a reverse configuration of the front seal 19 in that a frustoconical surface 23 tapers toward the free extremity and intersects a generally flat surface 24 extending perpendicularly to the axis of the associated shaft 28. Again, a sharp sealing edge is formed at the intersection of the two surfaces 24 and 23. A short cylindrical surface 25 interconnects the conical surface 23 to the shaft 28.

The shaft 28 is shown to comprise a pair of intersecting surfaces forming a cruciform shaped structure. Ribs 30 may be formed to interconnect the intersecting surfaces at spaced axial locations to reinforce the shaft.

Since it is a desire of the invention to reduce the cost of making a plunger and yet have an effective seal at the piston head, the configuration of a unitary piston head as just described is vitally important.

It will be noted that the outer diameter of the seal rings 19 and 22 will be slightly greater than the inner diameter of the respective bores 38 in the cartridge. This will create a resilient impingement between the two seal rings on each piston head and the respective compartment walls. The maximum transverse dimension of the ribs comprising the shaft 28 will be slightly less than the inner diameter of the compartment bores enabling feee movement but yet providing alignment and stability to the dispenser.

In use, the frontal surfaces 16 provide the majority of the surface contact area between the piston head and the fluids 54 and 56. The outer peripheral regions of the piston head comprise the conical surface 20. Due to the backwardly tapered configuration of the first sealing ring 19, the downward activation of the piston units allows the sharp tips to deflect backwardly, creating a wiping seal against the walls. Since the material 54 and 56 is viscous, the step-like structure created by surface 18 allows the front seal region to be properly supported structurally and yet permit the resilience required to create the wiping action. The region created between flat surfaces 21 and 24 thus may serve as a reservoir for any viscous fluid which may escape the front ring 19. Due to the configuration of the rear ring 22, the material which may enter the reservoir area is effectively scraped from the walls since conical surface 23 is tapered toward the direction of movement. This configuration results in an effective flattening of the edge rather than a bending over of the front edge 19. The in-use configuration of these front and back seal edges 19 and 22 may be seen from FIG. 5. Point A indicates that the frontal seal ring 19 is slightly bent backwardly, while the rear seal 22 is flattened at point B during its scraping action. Again the cylindrical section 25 serves as a support to the scraping ring 22.

It is preferable that the dispenser of the invention be made from a rigid plastic material such as high density polyethylene. The unitary construction of the piston head 14 permits this material to be structurally capable of dispensing a viscous fluid-like resin epoxy and yet capable of providing a firm seal without the use of a secondary sealing material.

Thus it is apparent that there has been provided in accordance with the invention of a dispenser unit, and particularly a unitary piston head on a plunger used in a dispenser unit, that fully satisfies the objects, aims and advantages set forth above. While the invention has been described in conjunction with specific embodiments thereof, it is evident that may alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A dispenser for precisely and substantially simultaneously metering small quantities of a plurality of viscous fluids stored therein with segregated compartments comprising a unitary cartridge body including a plurality of adjacent, parallel compartments with adjoining walls, a first extremity of said cartridge body including a flange extending outwardly of annular openings communicating with and of a diameter equal to the diameter of the respective compartment, the second extremity of said cartridge body including a plurality of nozzles creating closely adjacent aperture means communicating with respective compartments through channels of transverse dimensions less than the diameter of the respective compartment, a one-piece piston unit telescopically associated with said cartridge body, the unit comprising a plurality of piston shafts integrally joined at one end with a piston activating bight portion, the opposite ends of each piston shaft forming a piston head including integral seal means configured thereon, the seal means on each piston head including a pair of axially spaced seal rings having sharp edges at their outer peripheries, a first of said pair of spaced seal rings nearest the free extremity of each piston head including a frustoconical surface at the outer peripheral region thereof forming one side of the sharp edge, the frustoconical surface tapering backwards from said free extremity, the free extremity of each piston head further including a central, substantially frustoconical region representing a major portion of the frontal area and which is interconnected to the outer peripheral region by a short cylindrical surface region substantially about the axis of the piston shaft presenting a step-like piston head surface and defining the outer extremity of a primary liquid contacting surface, a second of said pair of seal rings which is disposed farthest from the free extremity of each piston head including a frustoconical surface at the outer peripheral region thereof forming one side of the sharp edge, the frustoconical surface on said second ring tapering forward toward the free extremity, the surface of the opposing sides of each frustoconical seal ring surface extending substantially perpendicular to the axis of the piston shaft, the diameter of each of the seal rings being substantially equal to one another and at least slightly greater than the inner diameter of the respective compartment so as to effect a resilient, wiping, press-fit with the inner walls of the compartments at two axial spaced regions of each compartment.

2. The dispenser of claim 1, wherein the piston shafts are substantially cruciform in cross section with a constant radial dimension throughout the length thereof which is substantially equal to the radial dimension of the associated compartments.

* * * * *